United States Patent [19]

Off et al.

[11] Patent Number: 4,534,303

[45] Date of Patent: Aug. 13, 1985

[54] APPARATUS FOR SEWING 360 DEGREE PATTERN

[75] Inventors: Joseph W. A. Off, Irving; Vivian Ferguson, Dallas, both of Tex.

[73] Assignee: Train-A-Mation, Inc., Irving, Tex.

[21] Appl. No.: 537,482

[22] Filed: Sep. 30, 1983

[51] Int. Cl.[3] ..... D05B 3/00; D05B 27/00

[52] U.S. Cl. ..... 112/114; 112/311; 112/309; 112/121.15

[58] Field of Search ..... 112/114, 104, 113, 115, 112/311, 309, 121.15, 121.12

[56] References Cited

U.S. PATENT DOCUMENTS

| | | | |
|---|---|---|---|
| 1,966,870 | 7/1934 | Rosenthal | 112/104 |
| 2,525,916 | 10/1950 | Lahner | 112/104 |
| 3,104,637 | 9/1963 | Hedegaard | 112/104 |
| 4,186,673 | 2/1980 | Vartoukian | 112/114 |
| 4,403,559 | 9/1983 | Hirose | 112/121.12 |
| 4,406,234 | 9/1983 | Johnson et al. | 112/121.12 |

*Primary Examiner*—Ronald Feldbaum

*Attorney, Agent, or Firm*—Kanz, Scherback & Timmons

[57] ABSTRACT

A sewing machine attachment (12) for sewing a label to a workpiece or sewing other 360 degree operations having a sliding cloth plate (22), cloth clamps (24 and 26), a backup clamp (32) and a template (30) for clamping the workpiece and label is disclosed. The template has first and second peripheral surfaces, and at least part of the contour of the first peripheral surface in a first position substantially aligns with at least part of the contour of the second peripheral surface in a second position. The template is moved between the first position and the second position during the 360 degree operation.

10 Claims, 5 Drawing Figures

APPARATUS FOR SEWING 360 DEGREE PATTERN

TECHNICAL FIELD

The present invention relates generally to attachments for sewing machines and, in one of its aspects, for sewing a substantially 360 degree pattern such as for attaching a label.

Automated and semiautomated sewing of labels to items of clothing has been hampered by the need to sew a full 360 degree pattern around a template or guide while holding the template or guide in position on the label. The template is used as a hold down for the label to keep the label in position with respect to the workpiece. The template must be held in place by a shank or other means which will interfere with the movement of the needle and prevent the traverse of a full 360 degree path.

BACKGROUND ART

In the past, some labels and design patterns were simply not sewn through a complete or substantially complete 360 degrees, while others were finished by moving the workpiece manually through the final portion of the pattern. Some templates were designed for the needle to follow an internal pattern which was cut out of the template. One such apparatus is shown in U.S. Pat. No. 4,305,338 of Adamson. In that arrangement, the labels are stacked in a hopper and fed automatically to the template where the edges of the label snaps under the edges of the open template and hold down member.

DISCLOSURE OF INVENTION

In accordance with the present invention, a sewing machine attachment for sewing a label to a workpiece includes a sliding cloth plate for supporting the workpiece, means for clamping the workpiece to the sliding cloth plate, a backup clamp for positioning below the workpiece and the label, a template for positioning above the workpiece and the label opposite the backup clamp, means for releasably clamping the cloth and the label between the backup the clamp and the template, and means for moving the template between a first position and a second position when the clamping means has released the workpiece and the label. The template, and in a preferred form the backup clamp also, has a first peripheral surface and a second peripheral surface. The second peripheral surface is spaced apart from the first peripheral surface with the first peripheral surface at the opposite end of the 360 degree sewing operation from the second peripheral surface. At least part of the contour of the first peripheral surface when the template is in the first position substantially aligns with at least part of the contour of the second peripheral surface when the template is in the second position. In one arrangement, there is at least partial overlap.

These and other objects, advantages and features of this invention will be apparent from the following description taken with reference to the accompanying drawing, wherein is shown the preferred embodiments of the invention.

BEST MODE FOR CARRYING OUT THE INVENTION

Figure 1:
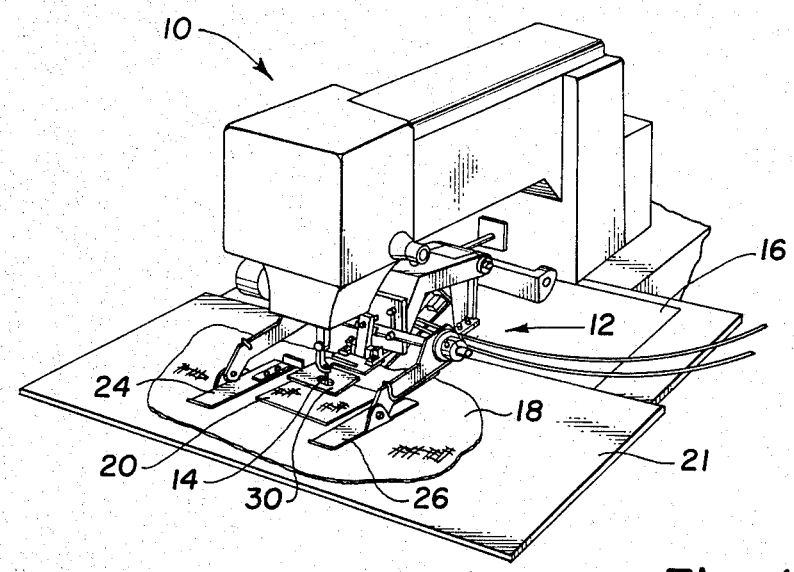
FIG. 1 is a perspective view of a sewing machine using an attachment according to the present invention.
Figure 2:
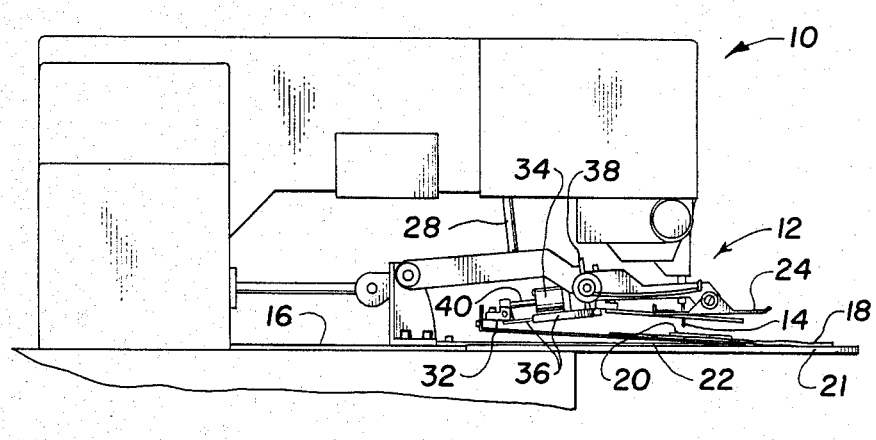
FIG. 2 is a left side elevational view of the sewing machine and attachment of FIG. 1.

Referring now to the drawing, and in particular to FIG. 1 and FIG. 2, a sewing machine for using the present invention is referred to generally by reference numeral 10, and an attachment according to the present invention is referred to generally by reference numeral 12. Sewing machine 10 includes a sewing needle 14 which, although it moves up and down in a "Z plane," is stationary with respect to the sewing machine in the other directions, "X-Y plane." Sewing machine 10 also includes an X-Y table (not shown) located below cover plate 16 which moves attachment 12 along with a workpiece 18 and a label 20 in the X-Y plane for creating a pattern to be sewn by needle 14.

Figure 3:
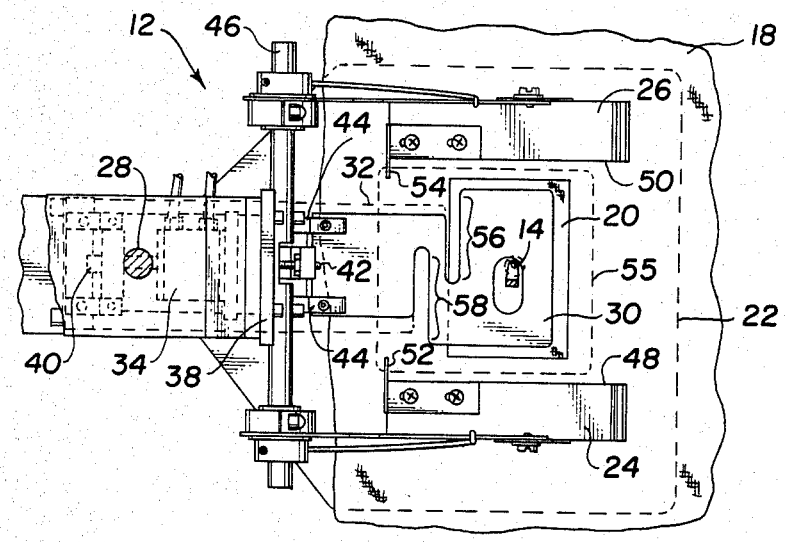
FIG. 3 is a top plan view of a sewing machine attachment according to the present invention operating on a label and workpiece showing the sewing machine needle in the initial rest position.

Workpiece 18 is placed on working surface 21 and is slid under needle 14 and some means for clamping the workpiece to a sliding cloth plate 22 such as cloth clamps 24 and 26. The operator then presses a foot pedal which actuates hydraulically or pneumatically driven rod 28, pressing cloth clamps 24 and 26 down, gripping workpieces 18 against sliding cloth plate 22. Label 20 is then slid underneath needle 14 and positioned below a template 30 as shown more clearly in FIG. 3. Template 30 is positioned above workpiece 18 and label 20 opposite a backup clamp 32 which is positioned below the workpiece and the label. Means for releasably clamping the cloth and the label between backup clamp 32 and template 30 includes a double acting hydraulic or pneumatic cylinder 34 which is affixed to slider 36 and plate 38. Cylinder 34 operates on rod 40. Referring in particular to FIG. 3, when cylinder 34 has been actuated fully in one direction, it moves template 30 into a first position and plate 38 acts upon a setscrew 42 which in turn pivots template 30 about pivot means 44, clamping workpiece 18 and label 20 between backup clamp 32 and the template. In normal operation, cloth clamps 24 and 26 can be adjusted on rod 46 so that edges 48 and 50 act as a guide for positioning label 20, and stops 52 and 54 are adjusted to allow the operator to correctly position the label in the front-to-back direction. Cloth clamps 24 and 26 and stops 52 and 54 are spread out for ease of illustration of the current example. Sliding cloth plate 22 forms a cutout 55 which is large enough for needle 14 to stitch around the pattern formed by template 30. The initial needle rest position is chosen merely for convenience and could be programmed for some other position.

Figure 4:
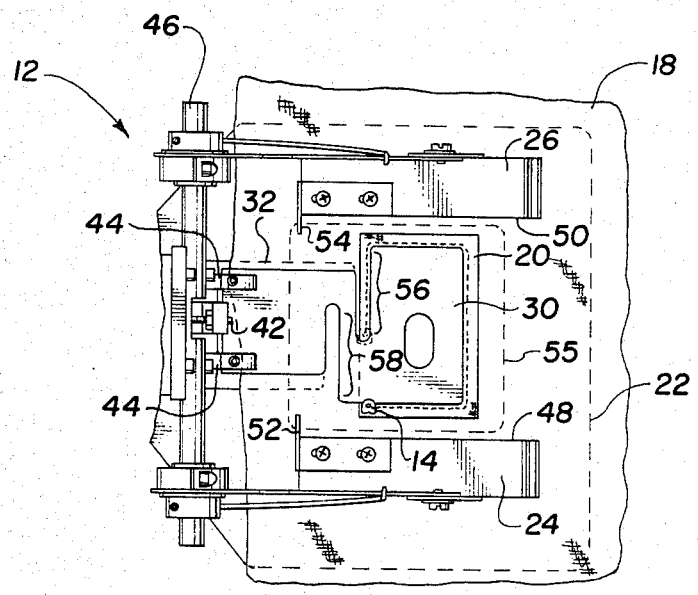
FIG. 4 is a top plan view of the sewing machine attachment of FIG. 3 operating on the label and workpiece showing the sewing machine needle having completed the traverse of the template contour in a first position.

Template 30 and backup clamp 32 each form a first peripheral surface 56 and a second peripheral surface 58. The workpiece and the label are moved by cover plate 16 relative to the needle 14 in a pattern that closely follows the peripheral surfaces, but the movement is not actually guided by those surfaces. As the workpiece and label are moved, needle 14 stitches parallel to peripheral surface 56 at the starting end of label 20. Sufficient margin is allowed between the periphery of the label and the periphery of the clamp for needle 14 and in some cases for a needle bushing or presser foot. Referring in particular to FIG. 4, needle 14 proceeds to stitch parallel to the contour of template 30, stitching the edge of label 20 until it comes in substantial alignment with first peripheral surface 56. The clamping action of template 30 and clamp 32 prevent the action of needle 14 from vibrating the material, a condition known as "flagging" in the industry.

Figure 5:
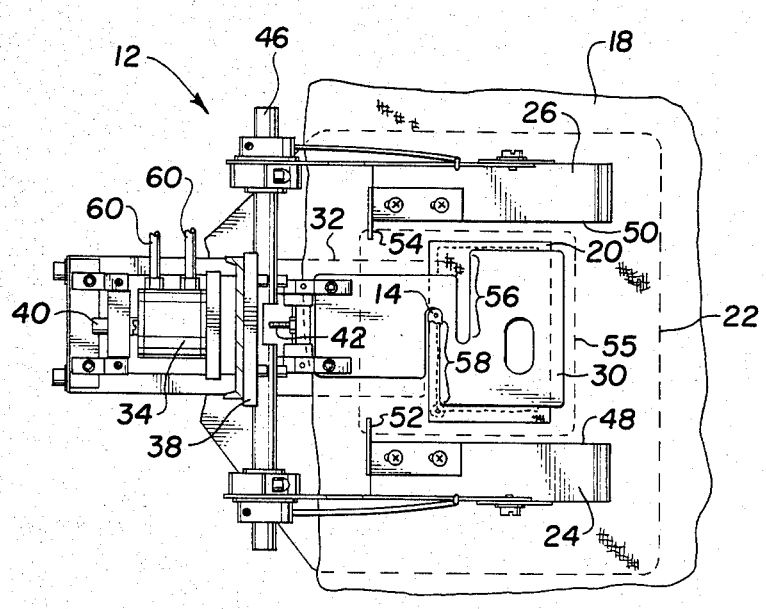
FIG. 5 is a top plan view of the sewing machine attachment of FIGS. 3 and 4 operating on the workpiece and label, showing the template in the second position and the sewing machine needle having finished the 360 degree pattern.

Referring now to FIG. 5, cylinder 34 is at this point automatically actuated to the opposite end of rod 40 through cylinder actuating means 60, which relieves the pressure from setscrew 42 releasing workpiece 18 and label 20 from the clamping action of backup clamp 32 and template 30. The action of cylinder 34 also moves template 30 and backup clamp 32 to a second position wherein the contour of second peripheral surface 58 substantially aligns with, and in this case at least partially overlaps with the contour of first peripheral surface 56 when the template and backup clamp were in the first position. Attachment 12 and sliding cloth plate 22 are then moved with respect to needle 14 so that needle 14 stitches parallel to the contour of second peripheral surface 58 and substantially completes attaching label 20 to workpiece 18 at the opposite end of the 360 degree sewing operation from its starting position.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the figures of the accompanying drawing is to be interpreted as illustrative and not in a limiting sense.

We claim:

1. A sewing machine attachment for sewing a label to a workpiece, comprising in combination:

a sliding cloth plate for supporting the workpiece;

means for clamping the workpiece to the cloth plate;

a backup clamp for positioning below the workpiece and the label;

a template for positioning above the workpiece and the label opposite the backup clamp, said template having a predetermined contour and including a first peripheral surface and a second peripheral surface;

means for releasably clamping the workpiece and the label between the backup clamp and the template; and means for moving the template between a first position and a second position when the clamping means has released the workpiece and the label wherein at least part of the contour of the first peripheral surface in the first position substantially aligns with at least part of the contour of the second peripheral surface in the second position.

2. A sewing machine attachment according to claim 1 wherein said means for moving comprises a double-acting hydraulic cylinder operatively connected to said backup clamp and said template.

3. A sewing machine attachment according to claim 1 wherein said means for moving comprises a double-acting pneumatic cylinder operatively connected to said backup clamp and said template.

4. A sewing machine attachment according to claim 1 wherein said template further includes a top surface lying substantially in a first plane, a bottom surface lying substantially in a second plane, said first peripheral surface connecting a first predetermined portion of said top and bottom surfaces, said first peripheral surface being substantially perpendicular to said first plane, said second peripheral surface connecting a second predetermined portion of said top and bottom surfaces, said second peripheral surface being substantially perpendicular to said first plane, said second peripheral surface being spaced apart from said first peripheral surface wherein said first peripheral surface is at the opposite end of a 360 degree sewing operation from the second peripheral surface.

5. A sewing machine attachment according to claim 4 further including a third peripheral surface connecting a third predetermined portion of said top and bottom surfaces, said third peripheral surface being substantially perpendicular to said first plane, said third peripheral surface also connecting between said first and second peripheral surfaces.

6. A template for attachment to a sewing machine having a first position and a second position for the template to guide a sewing operation through a substantially complete 360 degree pattern on a workpiece, the template comprising in combination:

a top surface lying substantially in a first plane and having a predetermined contour;

a bottom surface lying substantially in a second plane and having the predetermined contour, said second plane being substantially parallel to said first plane;

a first peripheral surface connecting a first predetermined portion of said top and bottom surfaces, said first peripheral surface being substantially perpendicular to said first plane;

a second peripheral surface connecting a second predetermined portion of said top and bottom surfaces, said second peripheral surface being substantially perpendicular to said first plane, said second peripheral surface being spaced apart from said first peripheral surface wherein said first peripheral surface is at the opposite end of the 360 degree sewing operation from the second peripheral surface and wherein at least a portion of the first peripheral surface in the first position for the template substantially aligns with at least a portion of the second peripheral surface in the second position for the template.

7. A template according to claim 6 further including a third peripheral surface connecting a third predetermined portion of said top and bottom surfaces, said third peripheral surface being substantially perpendicular to said first plane, said third peripheral surface also connecting between said first and second peripheral surfaces.

8. A combination template and backup clamp for attachment to a sewing machine having a first position and a second position for said combination to guide a sewing operation through a substantially complete 360 degree pattern on a workpiece, said combination template and backup clamp comprising:

a top template surface lying substantially in a first plane and having a predetermined contour;

a bottom template surface lying substantially in a second plane and having the predetermined contour, said second plane being substantially parallel to said first plane;

a first peripheral surface connecting a first predetermined portion of said top and bottom template surfaces, said first peripheral surface being substantially perpendicular to said first plane;

a second peripheral surface connecting a second predetermined portion of said top and bottom template surfaces, said second peripheral surface being substantially perpendicular to said first plane;

a top backup clamp surface lying substantially in a third plane and having the predetermined contour;

a bottom backup clamp surface lying substantially in a fourth plane and having the predetermined contour, said fourth plane being substantially parallel to said third plane;

a third peripheral surface connecting a first predetermined portion of said top and bottom backup clamp surfaces, said third peripheral surface being substantially perpendicular to said third plane; and a fourth peripheral surface connecting a second predetermined portion of said top and bottom backup clamp surfaces, said fourth peripheral surface being substantially perpendicular to said third plane;

said second peripheral surface and said fourth peripheral surface being spaced apart from said first peripheral surface and said third peripheral surface, respectfully, wherein said first peripheral surface and said third peripheral surface are at the opposite end of the 360 degree sewing operation from the second peripheral surface and the fourth peripheral surface, respectively, and wherein at least a portion of the first peripheral surface and the third peripheral surface in the first position for the combination template and backup clamp substantially align with at least a portion of the second peripheral surface and the fourth peripheral surface, respectively, in the second position for the combination template and backup clamp.

9. A combination template and backup clamp according to claim 8 further including a fifth peripheral surface connecting a third predetermined portion of said top and bottom template surfaces, said fifth peripheral surface being substantially perpendicular to said first plane, said fifth peripheral surface also connecting between said first and second peripheral surfaces.

10. A combination template and backup clamp according to claim 8 further including a sixth peripheral surface connecting a third predetermined portion of said top and bottom backup clamp surfaces, said sixth peripheral surface being substantially perpendicular to said third plane, said sixth peripheral surface also connecting between said third and fourth peripheral surfaces.

* * * * *